United States Patent [19]

Woolford

[11] Patent Number: 4,893,463

[45] Date of Patent: Jan. 16, 1990

[54] PRICKLE CHAIN DEVICE AND METHOD OF PRODUCTION THEREOF

[76] Inventor: Lyell J. Woolford, P.O. Box 66, Kimba 5641, South Australia, Australia

[21] Appl. No.: 247,932

[22] Filed: Sep. 22, 1988

[51] Int. Cl.[4] ..... B21L 1/00

[52] U.S. Cl. ..... 59/27; 59/35.1; 59/23; 72/381

[58] Field of Search ..... 59/23, 27, 35.1, 78, 59/83, 84, 87, 92; 140/49, 57; 152/240, 231; 72/306, 381, 384

[56] References Cited

U.S. PATENT DOCUMENTS

| | | | |
|---|---|---|---|
| 781,013 | 1/1905 | Nolle | 59/92 |
| 835,697 | 11/1906 | Appleton | 59/27 |
| 1,034,868 | 8/1912 | Breul | 59/83 |
| 2,341,428 | 2/1944 | Dorsey | 59/27 |
| 4,163,363 | 8/1979 | Widelbandt et al. | 59/27 |
| 4,209,978 | 7/1980 | Johansson | 59/27 |
| 4,471,819 | 9/1984 | Nihashi | 72/306 |
| 4,597,279 | 7/1986 | Lisec | 72/306 |
| 4,680,926 | 7/1987 | Lange | 59/27 |
| 4,694,644 | 9/1987 | Rudy et al. | 59/27 |

*Primary Examiner*—David Jones
*Attorney, Agent, or Firm*—Rodman & Rodman

[57] ABSTRACT

A prickle chain wherein each link has two side portions which are joined at one end by a curved bridge portion, the side portions terminating in respective outwardly projecting ends which cross each other and extend in opposite directions, the projections being the "prickles" of the chain. Each link is formed by engaging opposite ends of a straight rod in respective brackets which are pivoted by hydraulic piston/cylinder assemblies firstly to form the rod to a "U" shape, and then cause the ends to cross each other and project outwardly in opposite directions.

6 Claims, 5 Drawing Sheets

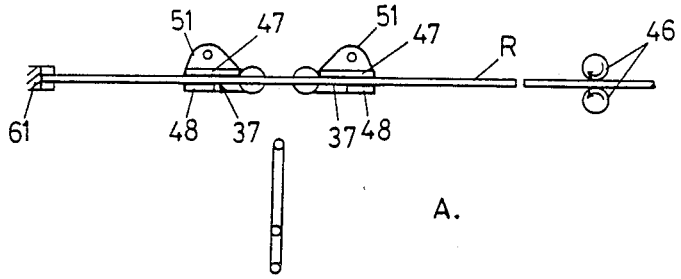
A.
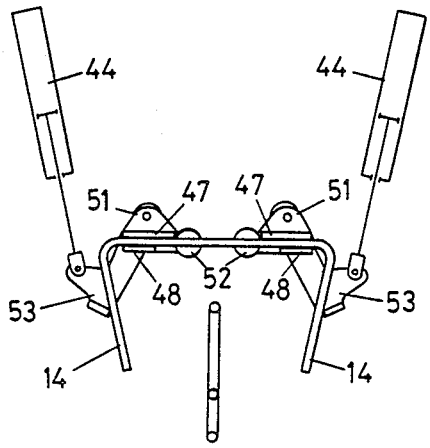
B.
FIG 5
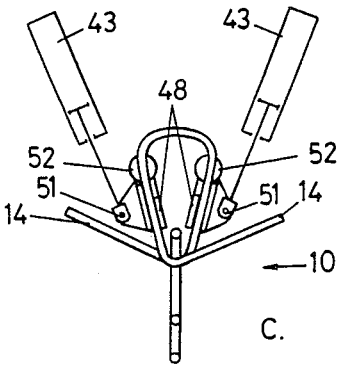
C.
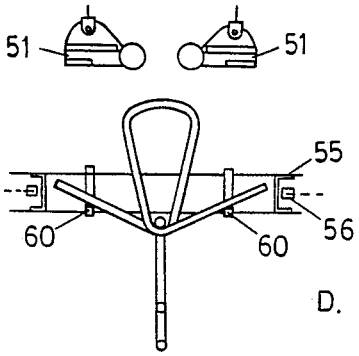
D.

PRICKLE CHAIN DEVICE AND METHOD OF PRODUCTION THEREOF

This invention relates to a prickle chain, that is a chain having projecting bars or "prickles" extending outwardly from its length and the invention also relates to a means and method of production of such a chain, although both the means and the method are also applicable to the production of closed loop chain.

BACKGROUND OF THE INVENTION

It has been discovered that a prickle chain is a valuable adjunct to the harrow system of farming, in that the projecting rods or "prickles" from chain links have the effect of breaking down trash residues, and assisting in removing weeds from the ground. However, heretofore prickle chains have been manufactured solely by welding spikes outwardly from the links of a chain, and this is essentially a time consuming and expensive operation. This is the only prior art known to the applicant.

BRIEF SUMMARY OF THE INVENTION

In this invention, a prickle chain comprises a plurality of links each of which comprises two side limb portions, and a curved bridge portion joining the side limb portions at one end, the side limb portions terminating in respective outward projections which cross one another at the other end. With this arrangement it is not necessary to effect any welding at all in the chain and thereby there is a considerable reduction in the cost of production, even when compared with ordinary long-link chain.

The invention extends further to the means of production of the chain, and in an embodiment of the invention, the means of production comprises at least one pair of pressure fluid actuated piston/cylinder assemblies, respective rod engaging means operatively coupled to each said assembly and so located with respect to each other as to guide the ends of a chain link rod to cross one another and project from one end of the chain link when that rod is being shaped by the rod engaging means to form the link by simultaneous actuation of the piston/cylinder assemblies. It can, for example, embody a machine having two spaced apart, nearly parallel cylinder/piston assemblies, one end of each assembly being coupled to a frame and the other being coupled to a double link itself hinged to the frame at a point spaced from the point where the piston/cylinder assemblies are coupled to the frame, each double link arrangement having a primary and secondary link, and guide means carried on the primary link for retaining a rod from which a chain link is to be produced, the rod extending at least to the end of the two link assemblies, and being arranged to be deformed firstly to a U-shape as the primary and secondary links move together, the frame having abutment means thereon to limit movement of the primary links so the subsequent movement of the secondary links crosses the ends of the rod over so that they are directed in generally opposite directions.

The invention still further extends to a method of chain production, comprising engaging a rod with at least two rod engaging means which are operatively coupled to respective piston/cylinder assemblies, and actuating the assemblies to bend the rod so as to form a chain link to have a curved bridge portion, two side portions, and two end portions which cross one another and project outwardly.

BRIEF SUMMARY OF THE DRAWINGS

Two embodiments of the invention are described hereunder in some detail with reference to, and are illustrated in, the accompanying drawings, in which:

FIG. 5 is a diagrammatic representation showing four stages in the method of producing a prickle chain, according to a second embodiment;

Figure 2:
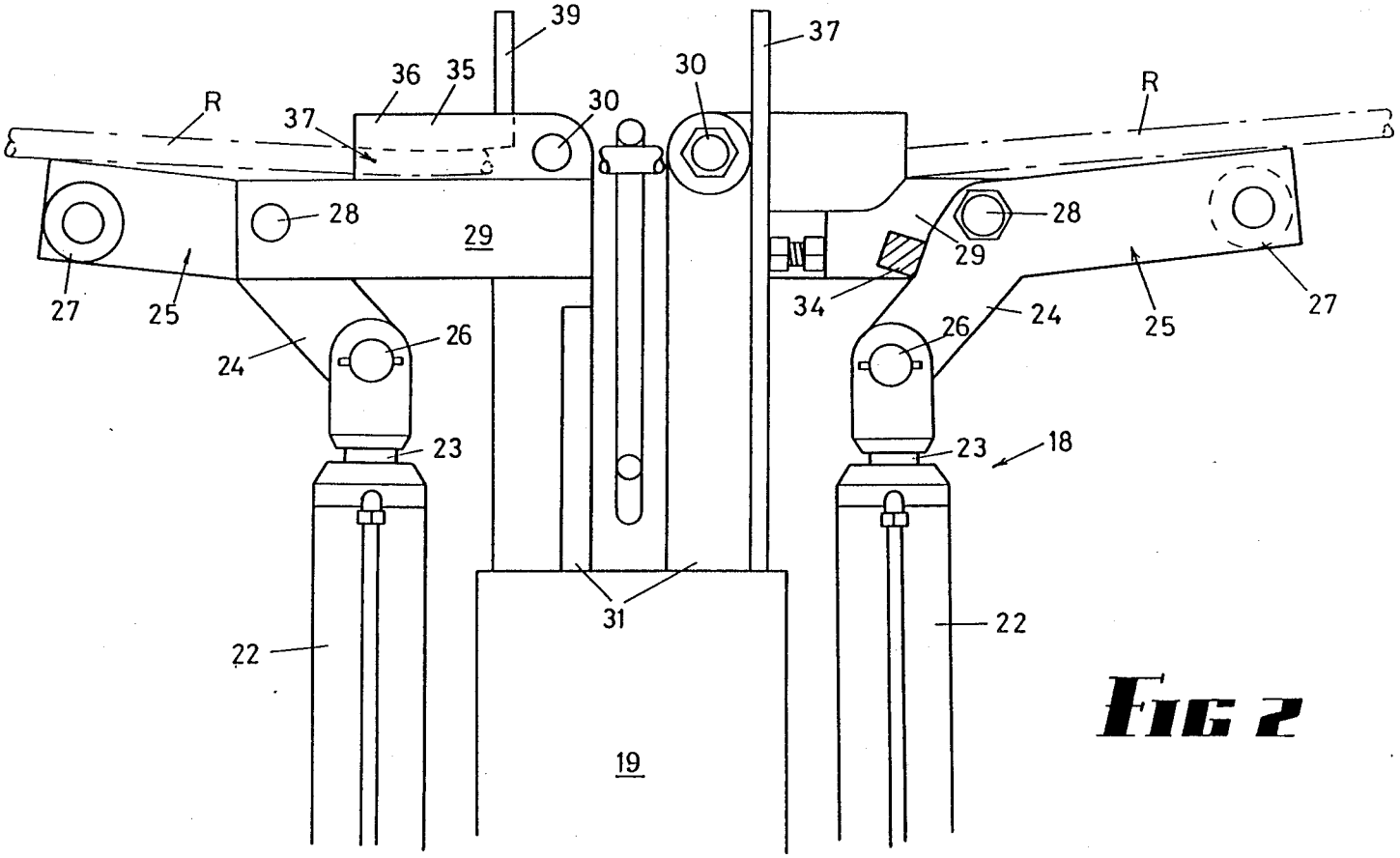
FIG. 2 is a fragmentary side elevation showing the means of the first embodiment.
Figure 3:
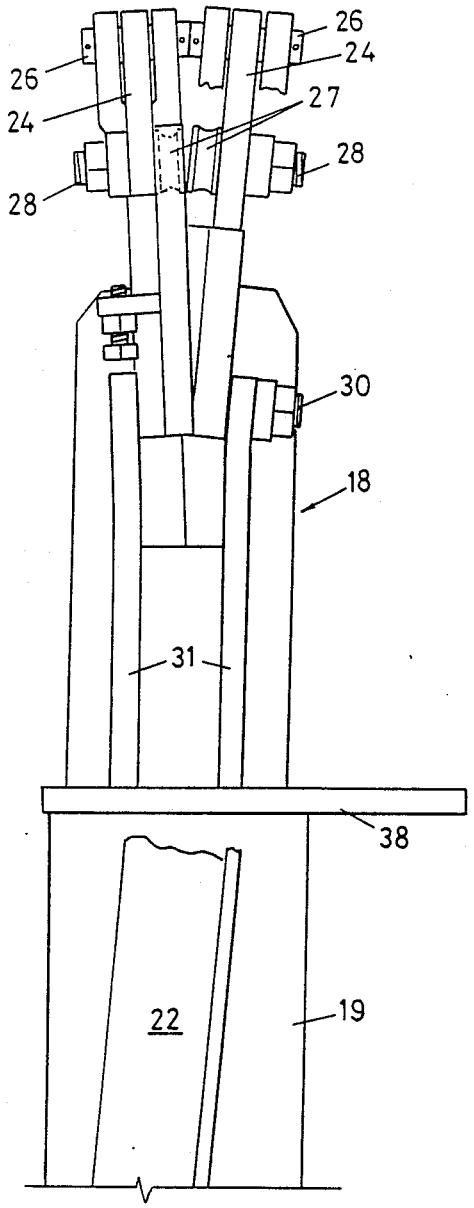
FIG. 3 is an end elevation of FIG. 2.
Figure 4:
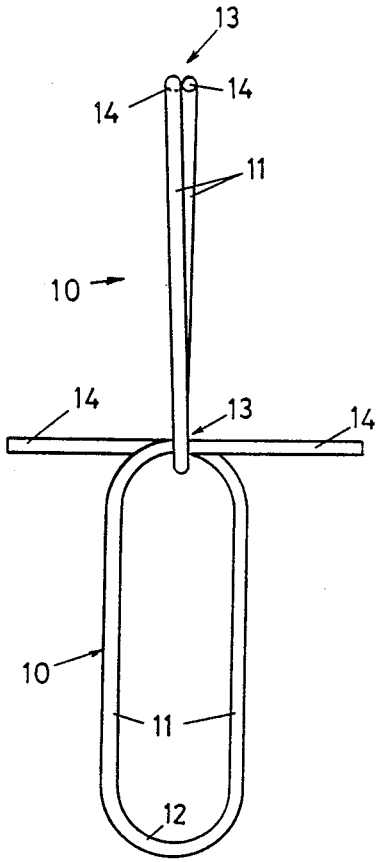
FIG. 4 shows two links of a prickle chain.

In the first embodiment of FIGS. 1 to 4, a chain link 10 (of which two are shown in FIG. 4) comprises a rod bent to have two side portions 11, joined together at one end by a U-shaped bridge portion 12, while at the other end the link ends cross one another at 13 and extend out in opposite directions as a pair of bars ("prickles") 14. These bars or prickles function as spikes if the chain is caused to rotate over the ground behind a tractor, at an angle inclined to the direction of travel. Heretofore such prickle chains have been produced by manually welding bars corresponding to the bars 14 onto links 10.

The invention extends to a means of producing such a chain, and FIGS. 2 and 3 illustrate such a means. In FIGS. 2 and 3 a chain forming machine 18 comprises a frame 19 having a base (not shown), the frame 19 having outstanding brackets (also not shown) to which are pivoted the lower ends of the cylinders 22 of piston/cylinder assemblies, the piston rods 23 of which are pivoted with respect to arms 24 of outer links 25 by the pivot pins 26. These outer links 25 have rollers 27 at their extremities, and are themselves pivoted on pivots 28 to inner links 29, the inner ends of the inner links 29 being coupled by tertiary pivots 30 to T-section posts 31 which are outstanding from and form portion of the frame 19.

Each inner link 29 is provided with an abutment bar 34 (FIG. 2) which is located between the pivots 26 and 28 when the arms 24 of the outer links 25 slope inwardly and downwardly as illustrated in FIG. 2 (that is, when the machine is ready to accept a rod 'R' for bending). As is seen best on the right-hand side of FIG. 2 the primary link 29 also abuts the outer surface of an outstanding T-section post 31, so that when in its retracted position as shown in that figure, the links 29 and the links 25 are nearly co-planar. Each link 29 however carries on it a retaining member 35 which cooperates with an outstanding plate 36 to form, with an upper portion of the link 29, a retaining channel 37, one retaining channel 37 facing to the front and the other to the rear.

In use, a rod 'R' of metal which is to be formed to a chain link is first placed across the links through a previously formed prickle chain link 'L', and into the channels 37 formed by the retaining members 35 and their own inner links 29. At this stage, the condition of the cylinders and link combinations is as illustrated in FIG. 2, and diagrammatically in FIG. 1(*a*).

Figure 1:
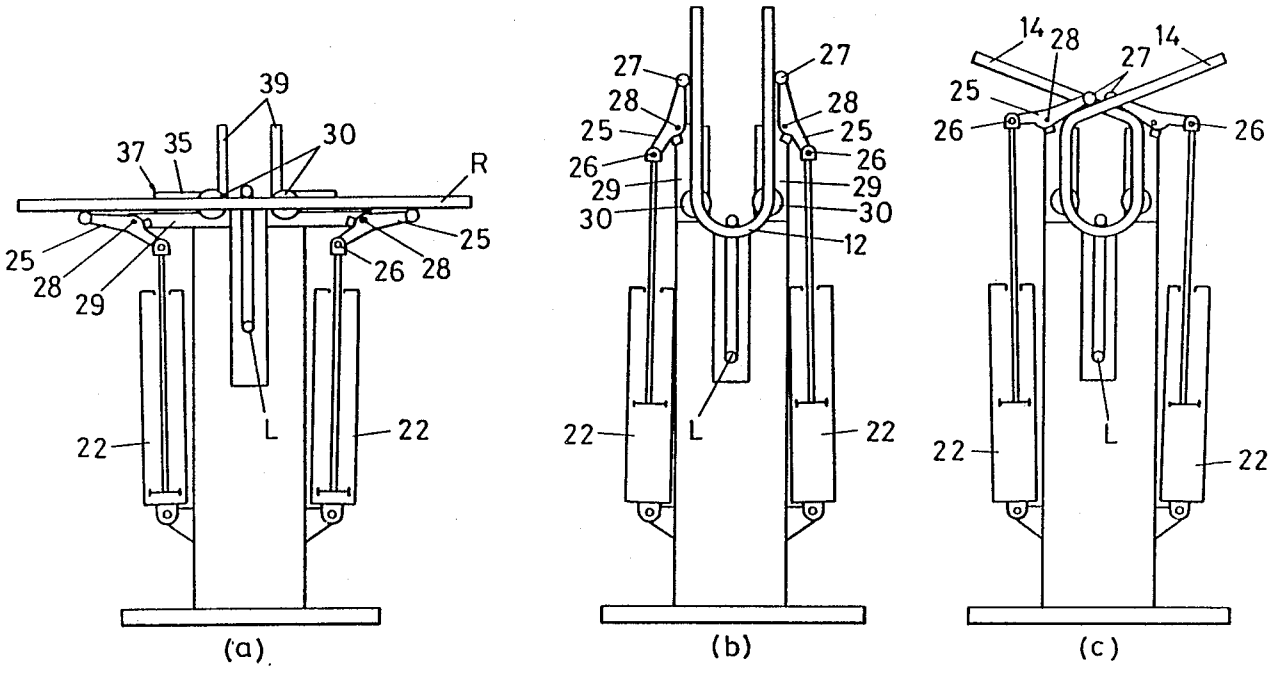
FIG. 1 is a diagrammatic representation showing three stages in the method of producing a prickle chain, according to a first embodiment.

The initial movement of the piston/cylinder assemblies 22 causes the two links on each side to move upwardly together and thereby form the U-shaped bridge portion 12 at the bottom of the chain link 10 (FIG. 1(*b*)). However, the swivelling movement being about the inner tertiary pivots 30 causes a corresponding outward movement of the pivot pins 26, and an inward movement of the secondary pivot pins 28 as they move upwardly above the plane of the tertiary pivot pins 30. When this occurs, the inner links 29 abut the extensions of the T-section posts 31 inhibiting further movement of the links 29, so that the side portions 11 of the chain link being formed remain parallel. However the pivot pins 26 are now effective in causing rotation of the outer links 25 because of the moment now imparted to those links, and this causes the rollers 27 to roll over the rod which is being formed into the chain link 10, in turn forming the outwardly facing bars 14 (shown only partly formed in FIG. 1(*c*)).

These rods 'P' are adjacent one another, since there is a small spacing between the rollers 27, as best seen in the end elevation of FIG. 3. To this end the piston/cylinder assemblies 22 are inclined to one another.

Figure 6:
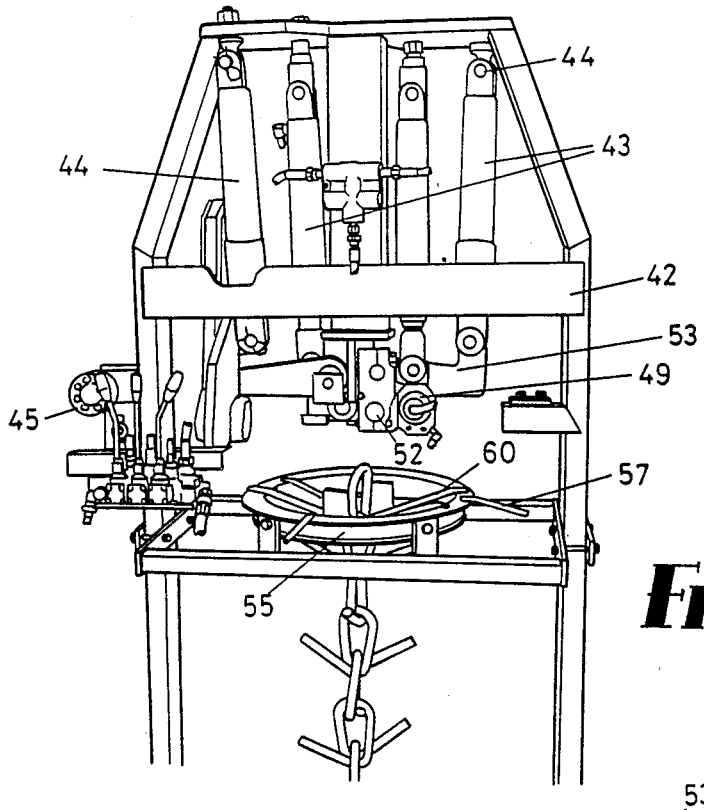
FIG. 6 is a front elevation of the means of the invention according to the second embodiment.
Figure 7:
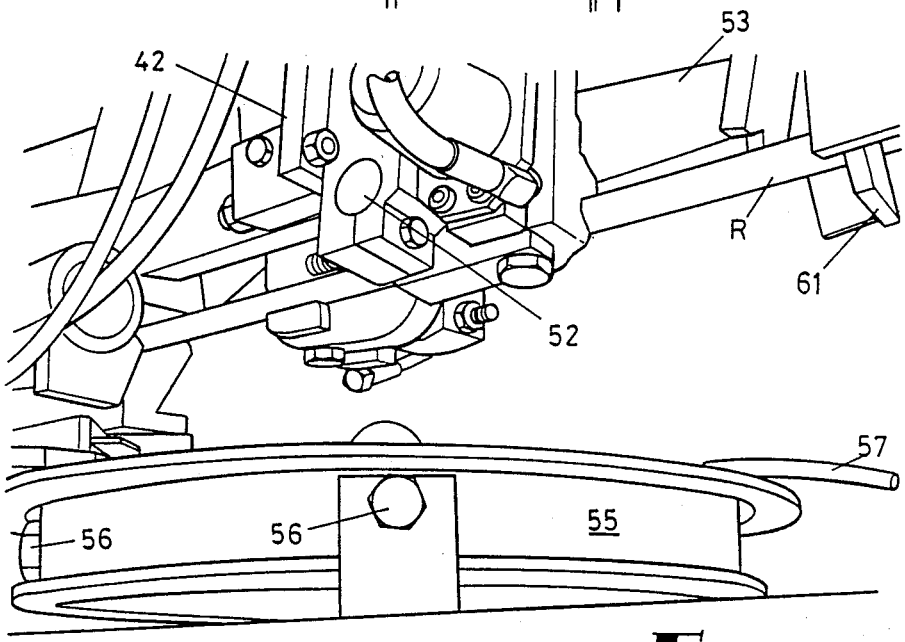
FIG. 7 is a fragmentary perspective showing a rod in the machine of FIG. 6, after engagement with means which guide the rod ends in the formation of prickle chain link, but before the rod is bent.

The second embodiment of FIGS. 5, 6 and 7 provides a machine which is more nearly automatic than that shown in the first embodiment although many of the principles are similar. In the second embodiment, a frame 42 supports two pairs of pressure fluid actuated piston/cylinder assemblies, the inner pair 43 functioning to form the eye of the chain link 10, while the outer pair 44 functions to bend the ends of the rod to form the outward projections (prickles 14). In the second embodiment the prickles 14 are formed before the eye of the link is formed, as seen best in FIG. 5(*b*).

FIGS. 5(*a*) and 6 show the rod 'R' having been driven into the machine by a feed drive motor 45 which drives rollers 46 (FIG. 5). This forces the rod 'R' between upper and lower rod retaining members 47–48, there being two of each. These retaining members co-operate with each other to form forwardly and rearwardly facing retaining channels 37, and as described below, the lower rod retaining members 48 are retractable by the retraction cylinders 49, one being directed forwardly and the other rearwardly. Each pair of rod retaining members however, is carried on a respective bracket 51, and the brackets 51 are hinged about the hinged pins 52 with respect to the frame 42. Brackets are themselves actuated by the inner pair of piston/cylinder assemblies 43.

The outer pair of piston/cylinder assemblies 44 are coupled as shown in FIG. 5(*b*) to a second pair of brackets 53 which lie outside the brackets 52 as shown in FIG. 5(*b*), and these brackets 53 perform the initial function of bending the rod 'R' as shown in FIG. 5(*b*) to form the two prickles 14, before actuation of the inner pair of piston/cylinder assemblies 43 completes the formation of the chain link as shown in FIG. 5(*c*).

After one chain link has been produced, the chain depends from an annular ring 55 which is carried on rollers 56 and can be moved by handle 57 between two pistons which are 90° apart. When the link has been produced, the prickles 14 are driven through the eye of a previously produced link which is retained approximately centrally and supported by the prickles bearing against a pair of cross bars 60 as shown best in FIG. 5(*d*), and the retraction cylinders 49 withdraw the lower rod retaining members 48 whereupon the inner pair of piston cylinder assemblies 43 immediately retract the brackets 51 as shown in FIG. 5(*d*), while at the same time (or immediately before or after) handle 57 is actuated to rotate the annular ring 55 so that the prickles of the previously formed link of the chain are no longer supported by the cross bar 60 but drop between them, and the prickles of the newly formed link fall to be supported by those cross bars.

The above description of the second embodiment has assumed that the rods 'R' will be cut to length and driven by rollers 46 into position against the stop 61 before the bending operation takes place. However, the invention can obviously be extended to incorporate the guillotine for severing the rod to be carried by the frame of the machine, and in lieu of hand operation of the annular ring, the ring can also be carried by a further piston/cylinder assembly thereby rendering the machine entirely automatic.

I claim:

1. A machine for the production of chain, comprising two spaced apart, nearly parallel cylinder/piston assemblies, one end of each assembly being coupled to a frame and the other being coupled to a double link itself hinged to the frame at a point spaced from the point where the piston/cylinder assemblies are coupled to the frame, each double link arrangement having a primary and secondary link, and guide means carried on the primary link for retaining a rod from which a chain link is to be produced, the rod extending at least to the end of the two link assemblies, and being arranged to be deformed firstly to a U-shape as the primary and secondary links move together, the frame having abutment means thereon to limit movement of the primary links so that subsequent movement of the secondary links crosses the ends of the rod over so that they are directed in generally opposite directions.

2. A machine for the production of chain having a frame, an inner pair and outer pair of pressure fluid actuated piston/cylinder assemblies:

a pair of inner brackets hinged to the frame and respectively coupled to the piston/cylinder assemblies of said inner pair, a respective first retaining member fixed to each said inner bracket, a respective retraction cylinder carried on each said inner bracket, and a second retaining member carried by each said retraction cylinder and being retractable thereby, each pair of first and second retaining members defining a respective retaining channel, a pair of outer brackets also hinged to the frame and respectively coupled to the piston/cylinder assemblies of said outer pairs and engageable against projecting portions of a rod when retained in said retaining channels so as to form said projecting portions of the rod into crossing "prickles", said pair of inner brackets being operable to form portion of the rod into the eye of a link and retract from the link thereby formed after retraction of said second retaining members by their respective retraction cylinders.

3. A machine according to claim 2 further comprising an annular ring beneath said piston/cylinder assemblies, means mounting the annular ring for rotation about a vertical axis, a pair of parallel cross bars extending across the annular ring and so spaced as to support the prickles of a chain link, but the inner diameter of the annular ring being greater than the span of the prickles as to allow that link to drop from cross bars when the ring is rotated by 90°.

4. A method of producing a link of chain in a machine having an inner pair of piston/cylinder assemblies and an outer pair of piston/cylinder assemblies, and inner and outer brackets coupled to respective said piston/-cylinder assemblies, at least two rod engaging means which are respectively coupled to respective said piston/cylinder assemblies, said rod engaging means comprising one fixed and one retractable retaining member on each said inner bracket, comprising:

(a) retaining an intermediate portion of said rod by said retaining members while engaging portions of the rod projecting therefrom by respective said outer brackets and actuating said outer pair of piston/cylinder assemblies to bend those projecting portions and form a pair of link "prickles", and (b) subsequently actuating said inner piston/cylinder assemblies to cause rotation of said inner brackets so as to form a bridge and side portions of the link and cause said projecting portions to cross each other, retracting said retractable retaining members from said inner brackets, and rotating those inner brackets a reverse direction to release the formed link therefrom.

5. A method according to claim 4 further comprising supporting a previously formed link beneath said brackets, and effecting step (b) of claim 4 so as to position said projecting "prickles" through the eye of the previous formed link and thereby form a chain.

6. A method of producing a link of a chain, comprising engaging an intermediate portion of a rod with the primary links of two rod engaging means each of which comprises a primary link, an outer link, pivot means joining the primary and outer links, and a piston/cylinder assembly operatively coupled to one end of the outer link, actuating both said piston/cylinder assemblies simultaneously to form the rod to a "U" shape, inhibiting further movement of the primary links when the rod is of said "U" shape, but continuing actuation of the piston/cylinder assemblies to continue movement of the outer links and thereby deform the projecting portions of the "U" shape rod to cross one another and project outwardly from one another.

* * * * *